US005853640A

United States Patent [19]

Furumai et al.

[11] Patent Number: 5,853,640

[45] Date of Patent: Dec. 29, 1998

[54] PROCESS FOR MAKING HIGH TENACITY ARAMID FIBERS

[75] Inventors: Takeji Furumai, Nagoya; Kouzou Imaeda, Susono, both of Japan; Stephen D. Moore, Powhatan, Va.; Mikio Ohno, Kounan, Japan

[73] Assignees: E. I. du Pont de Nemours and Company, Wilmington, Del.; Du Pont Toray, Tokyo, Japan

[21] Appl. No.: 950,250

[22] Filed: Oct. 14, 1997

Related U.S. Application Data

[60] Provisional application No. 60/029,452 Oct. 25, 1996.

[51] Int. Cl. [6] ..... D01D 5/06; D01F 6/60

[52] U.S. Cl. ..... 264/180; 264/184; 264/211.14

[58] Field of Search ..... 264/180, 184, 264/211.14

[56] References Cited

U.S. PATENT DOCUMENTS

| | | | |
|---|---|---|---|
| 3,767,756 | 10/1973 | Blades | 264/184 |
| 4,298,565 | 11/1981 | Yang | 264/184 X |
| 4,340,559 | 7/1982 | Yang | 264/184 X |
| 4,726,922 | 2/1988 | Cochran et al. | 264/184 |
| 4,965,033 | 10/1990 | Chiou | 264/180 |
| 5,173,236 | 12/1992 | Yang | 264/184 |
| 5,330,698 | 7/1994 | Allen et al. | 264/184 |

FOREIGN PATENT DOCUMENTS 357 017 A2 3/1990 European Pat. Off. .

*Primary Examiner*—Leo B. Tentoni

[57] ABSTRACT

A process is disclosed for making para-aramid filaments of especially high strength by extruding a solution of para-aramid through fine capillaries and drying the resulting filaments under high tension.

4 Claims, 1 Drawing Sheet

PROCESS FOR MAKING HIGH TENACITY ARAMID FIBERS

This is based on a provisional patent application number 60/029,452, filed Oct. 25, 1996.

BACKGROUND OF THE INVENTION

1. Field of the Invention

This invention relates to a process for making aramid fibers of especially high tenacity by means of a combination of process elements including particular spinneret capillary size, particular coagulating conditions, and particular drying tension.

2. Description of the Prior Art

U.S. Pat. No. 4,965,033, issued Oct. 23, 1990 on the application of Chiou, discloses a process for spinning aromatic polyamide fibers utilizing a high mass, jetted, flow of coagulating liquid.

U.S. Pat. No. 3,767,756, issued Oct. 23, 1973 on the application of Blades, and No. 5,173,236, issued Dec. 22, 1992 on the application of Yang, disclose spinning aromatic polyamide fibers utilizing spinnerets having capillaries from 0.025 to 0.25 millimeter (1 to 10 mils) and less than 0.064 millimiter (2.5 mils), respectively, and drying such fibers at tensions on the order of 0.3 grams per denier (gpd).

U.S. Pat. No. 4,726,922, issued Feb. 23, 1988 on the application of Cochran and Yang, discloses spinning aromatic polyamide fibers and drying them under tension of 3 to 7 grams per denier (gpd) to increase strength of the fibers.

SUMMARY OF THE INVENTION

There is provided a process for making yarn of poly(p-phenylene terephthalate) having a tenacity of at least 28 gpd comprising the steps of: (a) extruding filaments of an acid solution containing at least 30 grams per 100 milliliters of acid of poly(p-phenylene terephthalamide) having an inherent viscosity of at least 4, out of a spinneret and through a layer of inert noncoagulating fluid into a coagulating bath and then through a spin tube along with overflowing coagulating liquid; (b) jetting additional coagulating liquid symmetrically about the filaments in a downward direction forming an angle of 0° to 85° with respect to the filaments within about 2.0 milliseconds from the time the filaments enter the spin tube, (i) maintaining a ratio of the mass flow rate of combined overflowing and jetted coagulating liquid to mass flow rate of the filaments of greater than about 250, (ii) maintaining an average linear velocity of combined overflowing and jetted coagulating liquid in the spin tube which is less than the velocity of the filaments exiting from the spin tube, and (iii) maintaining constant the flow rates of both the jetted and the overflowing coagulating liquids; (c) and drying the filaments, the improvement comprising employing a spinneret having capillaries with diameters of up to 0.051 millimeter (2 mils) and drying the filaments under a tension of at least 3.0 grams per denier (gpd).

DETAILED DESCRIPTION OF THE INVENTION

Figure 1:
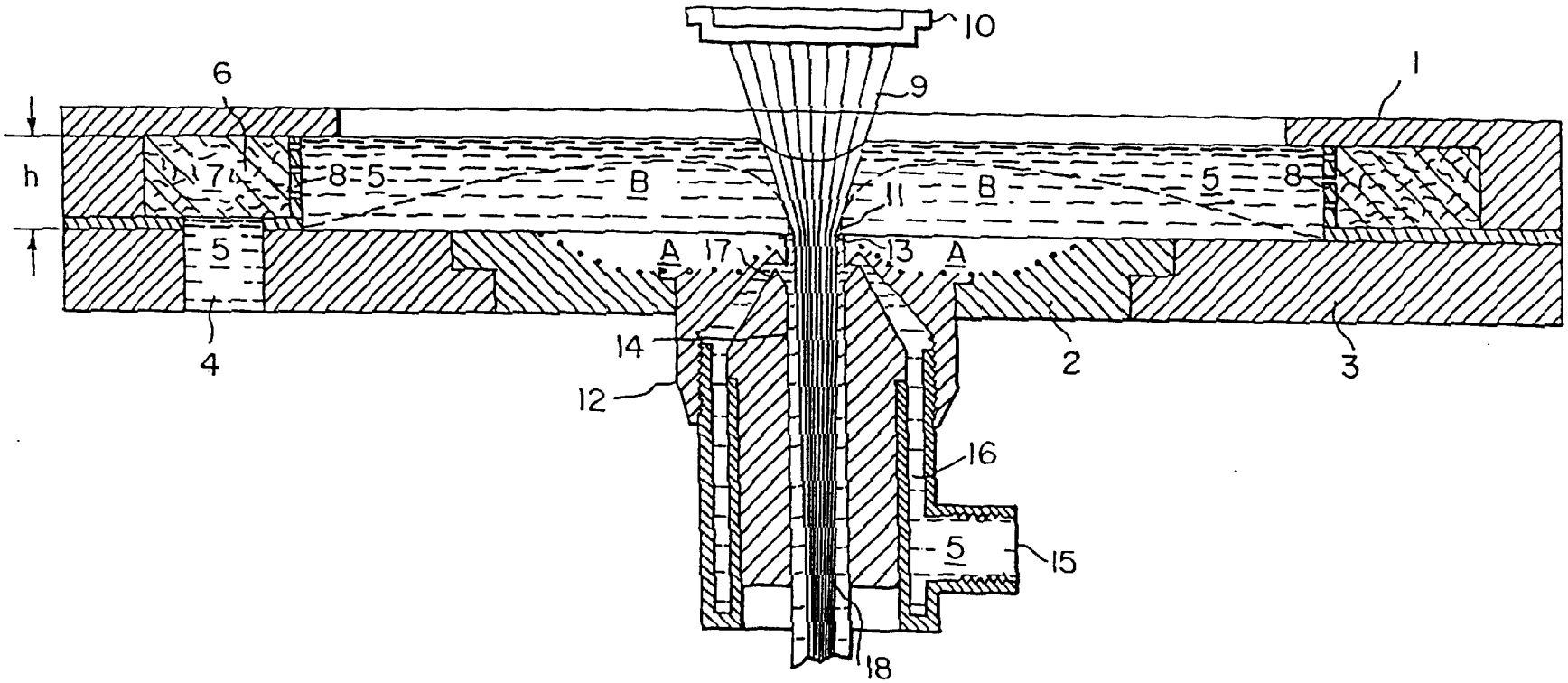
FIG. 1 is a cross-sectional view of an apparatus which can be used in practice of the process to make fibers useful in this invention.

There has been great effort expended in developing yarns and fabrics with increased strength. Each increase is hard-won and highly significant because even small increases yield significant benefits.

Yarns of the present invention have a tenacity of at least 28 gpd and can be made utilizing the device depicted in FIG. 1. These yarns are made, generally, in accordance with the process disclosed in U.S. Pat. No. 3,767,756 utilizing poly (p-phenylene terephthalamide) (PPD-T) having an inherent viscosity of at least 4.0 dissolved in sulfuric acid having a concentration of at least 98%. The PPD-T solution is extruded from a spinneret, through an air gap and into a coagulating bath. The spinneret has capillaries with a diameter of 0.051 millimeter (2.0 mils) or less. It has been found that capillaries of more than 0.051 millimeter (2 mils) yield fiber filaments which are believed to have poorer molecular orientation resulting in reduced strength and, therefore, not as strong as are made using capillaries of smaller diameter. As a practical matter, capillaries of less than about 0.025 millimeter (1 mil) are difficult to use and do not yield fibers of acceptable quality.

FIG. 1 is a cross-sectioned view of a preferred coagulating bath 1. Bath 1 is a circular structure consisting of an insert disc 2 fitted into supporting structure 3. Supporting structure 3 includes inlet 4 for introduction of quench liquid 5 under pressure into distribution ring 6 which contains filler 7 suitable to enhance uniform delivery of quench liquid around the periphery of coagulating bath 1.

Introduction of coagulating liquid to the bath may be from a peripheral manifold containing baffles or packing to provide uniform distribution and nonturbulent flow of coagulating liquid toward the orifice. In the case of a circular bath, the manifold can surround the bath. In the case of a rectangular bath with a slot orifice, the manifold can still surround the bath but coagulating liquid would be provided only on the sides of the bath which are parallel to the slot. It is necessary only that the flow of coagulating liquid toward the orifice be nonturbulent in the proximity of the orifice. Thus, filler 7 may be glass beads, a series of screens, a honeycomb structure, sintered metal plates, or other similar device.

After passing through filler 7, the quench liquid passes through perforated plate or screen 8 and flows uniformly without appreciable turbulence or back mixing horizontally toward the center of bath 1 where quench liquid 5 contacts filaments 9 extruded from spinneret 10 whereby both quench liquid 5 and filaments 9 pass together through orifice 11 in a downward direction into spin tube 14.

The bottom of the bath may be contoured as illustrated by the areas indicated by A and B to facilitate uniform nonturbulent flow toward opening 11. An area about the orifice may also taper toward the orifice. Preferably, the depth of the coagulating bath is no more than 20% of the bath width in the area of nonturbulent flow.

For spinning on a small scale, e.g., 20 filaments, a suitable bath width is about 6.35 cm (2.5 inches) in combination with an orifice having a diameter of 3.1 mm which has a tapered approach having a beginning diameter of about 12 mm. For larger scale spinning, e.g. 1,000 filaments, a suitable bath width is about 23 cm in combination with an orifice diameter of 9 mm which may have a tapered approach having a beginning diameter of about 28 mm.

Insert disc 2 includes circular jet device 12 which operates similarly to the jet device disclosed in U.S. Pat. No, 4,298,565. Orifice 11 preferably has a lip 13, i.e., orifice 11 is of slightly smaller diameter than spin tube 14, to help keep filaments 9 from adhering to the walls of orifice 11 and spin tube 14. Quench liquid 5 is introduced through opening 15 through passageway 16 to one or more jet openings 17 whereby the quench liquid 5 passes along with filaments 9 and other quench liquid 5 in a downward direction through the spin tube to exit 18 toward a forwarding device (not shown). In accordance with known procedures, the filaments are washed and/or neutralized and dried before wind-up of yarns produced by the process.

It is preferable for the angle for the liquid directed by jet openings 17 in relation to the filaments to form an angle (θ) in the range of 0 to 85 degrees. While satisfactory results are also obtainable for θ–90 degrees, this selection of theta, however, makes the process very critical to control and is, therefore, not as desirable in commercial operation. 30 degrees is a particularly suitable angle for use in a commercial production process. Jet openings 17 are located adjacent orifice 11 and direct the jetted coagulating fluid downwardly toward the filaments within about 2 milliseconds from the time the filaments enter the spin tube.

The process provides the most improvement when the spinneret, spin orifice, jet and any extension of the spin tube are carefully aligned on the same axis and when the jet elements are carefully designed and aligned to provide perfectly symmetrical jetting about the threadlines. Any misalignment of jet elements or the lodging of any solid particles in jet openings so as to destroy symmetry can reduce or eliminate the improvements. Such symmetry may be provided from two or more jet orifices, or from slots symmetrically spaced with respect to the thread line.

In accordance with the process, the flows of the overflowing coagulating liquid ($Q_1$) and jetted coagulating liquid ($Q_2$) are controlled and are maintained constant to achieve the improvement in accordance with the present invention. The mass-flow ratio (R) of the mass-flow rate of the filaments is controlled to be greater than about 250. Preferably, the mass-flow ratio (R) is greater than about 300.

In practice of the invention, flow-rate of overflowing coagulating fluid ($Q_1$) is controlled by adjustment of the depth of bath above orifice 11 (dimension h) by metering the inflow into the bath but also depends on the diameter of spin tube 14. Dimension h is ordinarily less than one inch (2.5 cm) and preferably about 0.5 inch (1.3 cm). If h is too small, air will be drawn into spin tube 14 by the pumping action of the advancing filaments, and such is deleterious to both tensile properties and mechanical quality of the yarn produced. Thus, h must be great enough to assure no entrainment of gas bubbles. The above considerations lead to calculation of a suitable diameter of spin tube 14. Because the overflow rate of quench liquid ($Q_1$) through the orifice is greatly influenced by the moving threadline through the same orifice, this effect must also be taken into account. For example, the overflow rate through a 9.5 mm (0.375 in.) diameter orifice under a hydrostatic head of 15.9 mm (0.625 in.) is approximately 1.5 liter/min (0.4 gallons/min) in the absence of a moving threadline, and 8.7 liter/min (2.3 gallons/min) in the presence of a threadline of 1000 filaments of 1.5 denier per filament moving at 686 m/min. This is commonly attributed to the pumping effect of moving filaments through a layer of liquid due to boundary layer phenomena. To compensate for this effect, the orifice size, i.e., diameter of cross-sectional area is suitably selected.

The flow-rate of jetted coagulating liquid ($Q_2$) is preferably controlled by metered pumping through a jet opening of selected size. The minor cross-sectional dimension of the jet (e.g., hole diameter or flow width) is generally in the range of 0.05 to 2.5 mm (2 to 100 mils). It is desirable for the flow-rate and the jet opening to be such that the axial velocity of the jetted coagulating liquid exceeds at least about 50% of that of the yarn being processed and preferably should exceed at least about 80% of the yarn velocity to prevent dragging of the threadline which results in a decrease in tenacity. However, the axial velocity of jetted coagulating liquid should not greatly exceed 200% of that of the yarn being processed and preferably does not exceed about 150% of the yarn velocity to prevent buffeting the threadline which can result in a reduction in measured yarn tenacity. It is therefore necessary to employ a suitable jetted liquid flow-rate and jet openings or slots which provide the mass-flow ratio of combined coagulating liquid to filament mass of greater than about 250, preferably greater than about 300, and the momentum ratio of jetted to overflowing coagulating liquids of greater than about 6.0 which also provide a suitable velocity for the jetted coagulating liquid in relation to yarn speed.

In the process of the invention, the average linear velocity of the combined coagulating liquids in the spin tube is maintained at a velocity less than the velocity of the filaments exiting from the spin tube. This prevents a loss of yarn tenacity due to "looping" of filaments in the yarn and possible process continuity problems due to the absence of sufficient tension before the feed rolls.

The present invention is useful for a wide range of spinning speeds and is particularly useful for spinning speeds of at least 300 m/min and preferably at least about 350 m/min although higher spinning speeds do result in a reduction in tenacity when compared with lower spinning speeds. While the advantages is tenacity produced by the process of the invention continue to increase with both increasing mass-flow ratio (R) and momentum ratio (ϕ) and thus can compensate for tenacity decreases due to continued increases in spinning speed, it is believed that mass-flow ratios (R) of above 5000 and momentum ratios (ϕ) above 50 will not yield any further significant improvement and will not be economically attractive for technical production, especially heavy deniers such as 1500 denier.

The fibers, once spun and passed through the coagulating bath, are washed and dried to complete the manufacture. Fibers must be thoroughly washed to remove all traces of acid and eliminate acid-related fiber degradation. Water alone or combinations of water and alkaline solutions can be used for fiber washing. A convenient method for washing is to spray the threadline, as it leaves the coagulating bath on rolls, with aqueous alkaline solutions (e.g. saturated $NaHCO_3$ or 0.05N NaOH), to reduce the acid content to about 0.01% (on a dry fiber basis).

The fibers can conveniently be dried on heated rolls (e.g. 16020 C.). The preferred washing method for this invention is to wash the fibers with a spray and pass them continuously to dryer rolls maintained at about 150° C.

One important element of the process of this invention involves drying the fibers under high tension of from about 3.0 to 7.0 grams per denier (gpd). Drying tensions of less than about 3.0 gpd result in fibers which have reduced molecular orientation resulting in reduced strength and drying tensions of greater than 7.0 gpd cause excessive threadline breakage and related operational difficulties. Drying tensions of about 3.0 to 5.0 gpd are particularly preferred.

Test Methods

Tensile Properties

Tenacity is reported as breaking stress divided by linear density. Modulus is reported as the slope of the initial stress/strain curve converted to the same units as tenacity. Elongation is the percent increase in length at break. Both tenacity and modulus are first computed in g/denier units which, when multiplied by 0.8826, yield dN/tex units. Each reported measurement is the average of 10 breaks.

Denier is the weight, in grams, of 9000 meters and dtex is the weight, in grams, of 10,000 meters of yarn or filament.

Tensile properties for yarns are measured at 24° C. and 55% relative humidity after conditioning under the test conditions for a minimum of 14 hours. Before testing, each yarn is twisted to a 1.1 twist multiplier (for example, nominal 1500 denier yarn is twisted about 0.8 turn/centimeter). Each twisted specimen has a test length of 25.4 cm and is elongated 50% per minute (based on the original unstretched length) using a typical recording stress/strain device.

The twist multiplier (TM) of a yarn is defined as:

$$TM = \frac{(tpi)\,(\text{Denier})^{1/2}}{73} = \frac{(tpc)\,(dtex)^{1/2}}{30.3}$$

Wherein tpi=turns per inch; and tpc=turns per centimeter.

Tensile properties for yarns are different from and lower than tensile properties for individual filaments and such values for yarns cannot successfully and accurately be estimated from filament values.

Momentum Ratio (ϕ)

The momentum ratio is defined as the ratio of momentum ($M_2$) along the threadline direction for jetted coagulating liquid to momentum ($M_1$) of the overflowing coagulating liquid; i.e., $\phi = M_2/M_1$. Momentum is defined as the product of the mass-rate and the velocity of flow. Calculation of momentum ratio is described in the aforementioned U.S. Pat. No. 4,298,565, and in the examples is computed from $$\phi = \frac{Q_2^2 \times d_1^2 \cos\theta}{4Q_1^2 \times d_2(d_1 + d_2 \cos\theta)}$$

wherein $Q_1$ is the flow rate of overflowing liquid $Q_2$ is the flow rate of jetted liquid $d_1$ is the inner diameter of the spin tube $d_2$ is the minor dimension of the jet opening θ is the acute angle between the jetted liquid and the threadline.

As long as $d_1$ and $d_2$ and $Q_1$ and $Q_2$ are in the same units, the ratio ϕ is independent of the units selected.

Mass-Flow Ratio (R)

This is the ratio of the mass-flow rate of total coagulating liquid to the mass-flow rate of filaments (dry basis). The basic unit of liquid flow rate Q herein is gal/min.

$$Q \times 3899 = \text{mass-flow in g/min}$$

For the yarn, basic units are speed (Y) in yd/min and denier (D) in g/9000 m.

$$YD \times (0.9144/9000) = \text{mass-flow in g/min.}$$

The mass-flow then becomes Q/YD×3.8376×107.

In this equation, it is assumed that density of the coagulating liquid is about 1.03 g/ml.

EXAMPLES

In the following examples, poly(para-phyenylene terephthalamide) (PPD-T) having an inherent viscosity of about 6.3 dL/g before solutioning and about 5.5 dL/g in fiber form was spun into apparatus as illustrated in U.S. Pat. No. 4,340,559 using tray G. The diameter of the spin tube was 0.76 cm (0.3 inch) and jets of 0.21 and 0.42 millimeters (8 and 16 mils) were employed with an angle of 30 degrees between the jetted stream and the threadline. The solvent employed in making spin dope was about 100.1% sulfuric acid and the concentration of polymer in the spin dope of about 19.4 wt. %.

As indicated in TABLES I and II, the spinnerets of 0.051 and 0.064 millimeters (2.0 and 2.5 mils) were employed. The number of capillaries of spinnerets employed included 133, 266, 400, 500, 560 and 666 capillaries. The air-gap, i.e., the distance of filament travel from the exit face of the spinneret to the first contact with coagulating liquid, was about 0.635 cm (0.25 inch). The coagulating liquid was maintained at about 3° C. Yarn tensions of about 1.0 gpd during washing and neutralization were employed for all of the examples described below.

Examples of the invention utilized a massflow ratio (R) of 325 to 1680, along with spinnerets with capillaries of 0.051 millimeter. The yarns were dried under tension of greater than 2 grams per denier and the yarns had linear densities of 160 to 1500 denier.

Comparative examples utilized the same polymer and the same spinning apparatus under the same conditions, except that the mass-flow ratios, the momentum ratios, the drying tensions, and the spinneret capillary sizes were different as shown in TABLE 1.

TABLE I

| | Invention | | Comparative | | | | | |
|---|---|---|---|---|---|---|---|---|
| Conditions | 1 | 2 | A | B | C | D | E | F |
| Capillary Diam (mil) | 2.0 | 2.0 | 2.5 | 2.0 | 2.5 | 2.5 | 2.5 | 2.5 |
| No. filaments | 266 | 400 | 133 | 133 | 266 | 500 | 560 | 666 |
| Drying tension (gpd) | 3.5 | 3.5 | 0.7 | 0.3 | 2.0 | 2.1 | 2.1 | 2.1 |
| Jet width (mil) | 16 | 16 | 8 | 16 | 8 | 8 | 8 | 8 |
| Q1 (gal/min) | 1.32 | 1.32 | 1.6 | 1.3 | 1.4 | 1.7 | 1.7 | 1.7 |
| $Q_2$ (gal/min) | 1.65 | 1.65 | 1.1 | 2.0 | 0.9 | 0.9 | 0.9 | 0.9 |
| Speed (ypm) | 400 | 400 | 750 | 500 | 400 | 400 | 400 | 400 |
| ϕ (Momentum) | 6.1 | 6.1 | 3.8 | 9.2 | 3.3 | 2.2 | 2.2 | 2.2 |
| R (Mass) | 712 | 475 | 690 | 1266 | 552 | 332 | 297 | 249 |
| Yarn Properties | | | | | | | | |
| Yarn Denier | 400 | 600 | 200 | 200 | 400 | 750 | 840 | 1000 |
| Den./Filament | | | | | | | | |
| Tenacity (gpd) | 28.5 | 28.2 | 23 | 27 | 27 | 26.5 | 27 | 26.5 |
| Elong. (%) | 3.2 | 3.2 | 3.0 | 3.5 | 3.3 | 3.3 | 3.4 | 3.4 |
| Modulus (gpd) | 830 | 800 | 750 | 700 | 760 | 740 | 760 | 740 |

In the following examples, PPD-T of the same quality as used above, was spun using the same apparatus and spinning conditions as used above with the exception that different spinnerets were used and some other conditions were changed, as shown in Table II. Table II, also, shows the yarn properties of these examples.

TABLE II

| | Invention | | | | | | | Comparative | |
|---|---|---|---|---|---|---|---|---|---|
| Conditions | 1 | 2 | 3 | 4 | 5 | 6 | 7 | A | B |
| Capillary Diam (mil) | 2.0 | 2.0 | 2.0 | 2.0 | 2.0 | 2.0 | 2.0 | 2.5 | 2.5 |
| No. filaments | 270 | 270 | 270 | 270 | 270 | 1000 | 1000 | 1000 | 1000 |
| Drying tension (gpd) | | | -------- 3.0 to 3.5------- | | | | | 2.3 | 0.8 |
| Jet width (mil) | 16 | 16 | 16 | 16 | 16 | 16 | 16 | 8 | 8 |
| $Q_1$ (gal/min) | | | | | | | | | |
| $Q_2$ (gal/min) | | | | | | | | | |
| Speed (ypm) | 350 | 350 | 350 | 350 | 350 | 350 | 350 | 350 | 775 |
| $\phi$ (Momentum) | | | | | | | | | |
| R (Mass) | 1075 | 1075 | 1275 | 1680 | 785 | 370 | 325 | 199 | 140 |
| Yarn Properties | | | | | | | | | |
| Yarn Denier | 270 | 270 | 216 | 162 | 400 | 1000 | 1200 | 1500 | 1500 |
| Den./Filament | 1.0 | 1.0 | 0.8 | 0.6 | 1.5 | 1.0 | 1.2 | 1.5 | 1.5 |
| Tenacity (gpd) | 31.3 | 30.9 | 31.0 | 30.2 | 29.5 | 28.7 | 28.6 | 26.5 | 23.5 |
| Elong. (%) | 3.4 | 3.4 | 3.4 | 3.3 | 3.5 | 3.6 | 3.6 | 3.0 | 3.6 |
| Modulus (gpd) | 934 | 887 | 862 | 819 | 850 | 820 | 810 | 760 | 570 |

What is claimed is:

1. A process for making filaments of poly(p-phenylene terephthalamide) having a tenacity of at least 28 grams per denier comprising the steps of: (a) extruding filaments of an acid solution containing at least 30 grams of poly(p-phenylene terephthalamide) having an inherent viscosity of at least 4 per 100 milliliters of acid, out of a spinneret and through a layer of inert noncoagulating fluid into a coagulating bath and then through a spin tube along with overflowing coagulating liquid; (b) jetting additional coagulating liquid symmetrically about the filaments in a downward direction forming an angle of 0 to 85 degrees with respect to the filaments within 2.0 milliseconds from the time the filaments enter the spin tube, (i) maintaining a ratio of the mass flow rate of combined overflowing and jetted coagulating liquid to mass flow rate of the filaments of greater than 250, (ii) maintaining an average linear velocity of combined overflowing and jetted coagulating liquid in the spin tube which is less than the velocity of the filaments exiting from the spin tube, and (iii) maintaining constant the flow rates of both the jetted and the overflowing coagulating liquids; and (c) drying the filaments, the improvement comprising employing a spinneret having capillaries with diameters of up to 0.051 millimeter (2 mils) and drying the filaments under a tension of at least 3.0 grams per denier.

2. The process of claim 1 wherein the ratio of the mass flow rate of combined overflowing and jetted coagulating liquid to mass flow rate of the filaments is greater than 300.

3. The process of claim 1 wherein the diameter of the spinneret capillaries is 0.025 millimeter (1 mil) to 0.051 millimeter (2 mils).

4. The process of claim 1 wherein the filaments are dried under a tension of 3.0 grams per denier to 7.0 grams per denier.

* * * * *